US005318436A

United States Patent [19]

Colket, III et al.

[11] Patent Number: 5,318,436

[45] Date of Patent: Jun. 7, 1994

[54] LOW $NO_x$ COMBUSTION PILOTED BY LOW $NO_x$ PILOTS

[75] Inventors: Meredith B. Colket, III, Simsbury; Daniel J. Seery, Glastonbury; Joseph J. Sangiovanni, West Suffield, all of Conn.

[73] Assignee: United Technologies Corporation, Hartford, Conn.

[21] Appl. No.: 791,835

[22] Filed: Nov. 14, 1991

[51] Int. Cl.[5] ..... F23C 5/00

[52] U.S. Cl. ..... 431/8; 431/2; 431/284; 431/285; 431/278

[58] Field of Search ..... 431/8, 2, 5, 202, 278, 431/285, 284; 60/39.02, 723

[56] References Cited

U.S. PATENT DOCUMENTS

| | | | |
|---|---|---|---|
| 2,655,786 | 10/1953 | Carr | 60/35.4 |
| 2,947,600 | 8/1960 | Clayton | 431/5 X |
| 3,075,492 | 12/1972 | Vickers . | |
| 3,433,218 | 3/1969 | Von Wiesenthal | 431/5 X |
| 3,975,900 | 8/1976 | Pfefferle | 60/39.03 |
| 4,054,407 | 10/1977 | Carrubba et al. | 431/10 |
| 4,154,567 | 5/1979 | Dahmen | 431/5 |
| 4,864,811 | 9/1989 | Pfefferle | 60/39.06 |
| 4,870,824 | 10/1989 | Young et al. | 60/723 |
| 4,875,850 | 10/1989 | Cagnon et al. | 431/8 |
| 4,983,364 | 1/1991 | Buck et al. | 431/5 X |
| 4,988,287 | 1/1991 | Stegelman et al. | 431/5 X |

FOREIGN PATENT DOCUMENTS

| | | |
|---|---|---|
| 0269824 | 6/1988 | European Pat. Off. . |
| 0335978 | 10/1989 | European Pat. Off. . |
| 58-108332 | 6/1983 | Japan . |
| 61-053425 | 3/1986 | Japan . |
| 02259331 | 10/1990 | Japan . |
| 04217701 | 8/1992 | Japan . |

OTHER PUBLICATIONS

Patent Abstracts of Japan, vol. 15, No. 008 (M-1067) 9 Jan. 1991.

Patent Abstracts of Japan, vol. 7, No. 215 (M-244) 22 Sep. 1983.

Patent Abstracts of Japan, vol. 10, No. 216 (M-502) 29 Jul. 1986.

Database WPIL, Section PQ, Week 9238, Derwent Publications Ltd., London. GB; Class Q73, AN 92312285.

Gas Turbine Combusion, by A. H. Lefebvre, published by McGraw-Hill Book Company May 1983, pp. 44-57 and 481-485 were relied on by the Examiner in U.S. application Ser. No. 07/701,426.

*Primary Examiner*—Carl D. Price

*Attorney, Agent, or Firm*—George J. Romanik

[57] ABSTRACT

An improved method of burning a hydrocarbon fuel in a combustion system includes burning the fuel in a main burner under fuel-lean conditions to produce a main flame and burning a low heating value fuel in a pilot burner to stabilize the main flame and limit the amount of $NO_x$ produced in the pilot burner. The pilot fuel can inherently have a low heating value, can be a diluted high heating value fuel, or can be made by partially oxidizing a high heating value fuel. An improved combustion system for burning a hydrocarbon fuel with limited $NO_x$ emissions has a main burner, a pilot burner, and a partial oxidation stage capable of converting a high heating value fuel to a low heating value fuel in a partial oxidation reaction. The system also has means for burning the low heating value fuel in the pilot burner. The system can include means for removing heat from the partial oxidation stage or low heating value fuel to lower the temperature of the pilot flame.

8 Claims, 2 Drawing Sheets

LOW $NO_x$ COMBUSTION PILOTED BY LOW $NO_x$ PILOTS

CROSS-REFERENCE TO RELATED APPLICATION

This application is related to commonly assigned U.S. application Ser. No. 07/701,426, now U.S. Pat. No. 5,235,804, filed on May 15, 1991, entitled "Method and System for Combusting Hydrocarbon Fuels With Low Pollutant Emissions."

TECHNICAL FIELD

The present invention is directed to the combustion of hydrocarbon fuels with low $NO_x$ emissions.

BACKGROUND ART

Hydrocarbon fuels have long been known to produce atmospheric pollutants when burned. The pollutants typically include nitric oxide (NO) and nitrogen dioxide ($NO_2$), frequently grouped together as nitrogen oxides or $NO_x$, unburned hydrocarbons (UHC), carbon monoxide (CO), and particulates, primarily carbon soot. $NO_x$ is of particular concern because of its role in forming ground level smog and acid rain and in depleting stratospheric ozone.

Hydrocarbon combustion forms $NO_x$ by several mechanisms. The high temperature reaction between atmospheric oxygen and atmospheric nitrogen, particularly at flame temperatures above about 1540° C. (2800° F.), forms $NO_x$ through the thermal or the Zeldovich mechanism ("thermal $NO_x$"). The reaction between atmospheric nitrogen and hydrocarbon fuel fragments ($CH_i$ ), particularly under fuel-rich conditions, forms $NO_x$ through the prompt mechanism ("prompt $NO_x$"). The reaction between nitrogen released from a nitrogen-containing fuel and atmospheric oxygen, particularly under fuel-lean conditions, forms $NO_x$ through the fuel-bound mechanism ("fuel-bound $NO_x$"). Typically, atmospheric oxygen and nitrogen are readily available for the $NO_x$-forming reactions in combustion air that is mixed with the fuel.

To limit $NO_x$ formation, many modern combustors burn fuel that has little or no nitrogen and operate at uniformly fuel-lean conditions. Burning low nitrogen fuel reduces or eliminates the formation of fuel-bound $NO_x$. Operating under uniformly fuel-lean conditions, for example, by using a lean premixed/prevaporized system, reduces the formation of $NO_x$ by the thermal and prompt mechanisms. The excess air used to achieve fuel-lean conditions reduces thermal $NO_x$ formation by acting as a diluent to decrease flame temperatures. The excess air also decreases the concentration of $CH_i$ available to react with atmospheric nitrogen, thereby reducing the formation of prompt $NO_x$. The amount of excess air needed to reduce thermal and prompt $NO_x$ formation can, however, cause the combustor to operate near its lean combustion limit, resulting in flame instability. Flame stability can be improved by supplementing the main flame with a pilot flame to ensure that the main flame remains lit, even at very lean conditions.

While fuel-lean combustion can successfully reduce $NO_x$ formation, there is a need to find ways of further reducing $NO_x$ production to meet increasingly stringent emission regulations. Therefore, what is needed in the industry is an improved fuel-lean, low $NO_x$ combustion system.

DISCLOSURE OF THE INVENTION

The present invention is directed to an improved fuel-lean, low $NO_x$ combustion system.

One aspect of the invention includes a method of burning a hydrocarbon fuel in a combustion system by burning the fuel in a main burner under fuel-lean conditions to produce a main flame and burning a pilot fuel in a pilot burner to stabilize the main flame. The improvement includes burning a low heating value fuel in the pilot burner to limit the amount of $NO_x$ produced in the pilot burner.

Another aspect of the invention includes a combustion system for burning a hydrocarbon fuel with limited $NO_x$ emissions that has a main burner and a pilot burner. The improvement includes a partial oxidation stage capable of converting a high heating value fuel to a low heating value fuel in a partial oxidation reaction. The system also has means for burning the low heating value fuel in the pilot burner.

These and other features and advantages of the present invention will become more apparent from the following description and accompanying drawings.

BEST MODE FOR CARRYING OUT THE INVENTION

Figure 1:
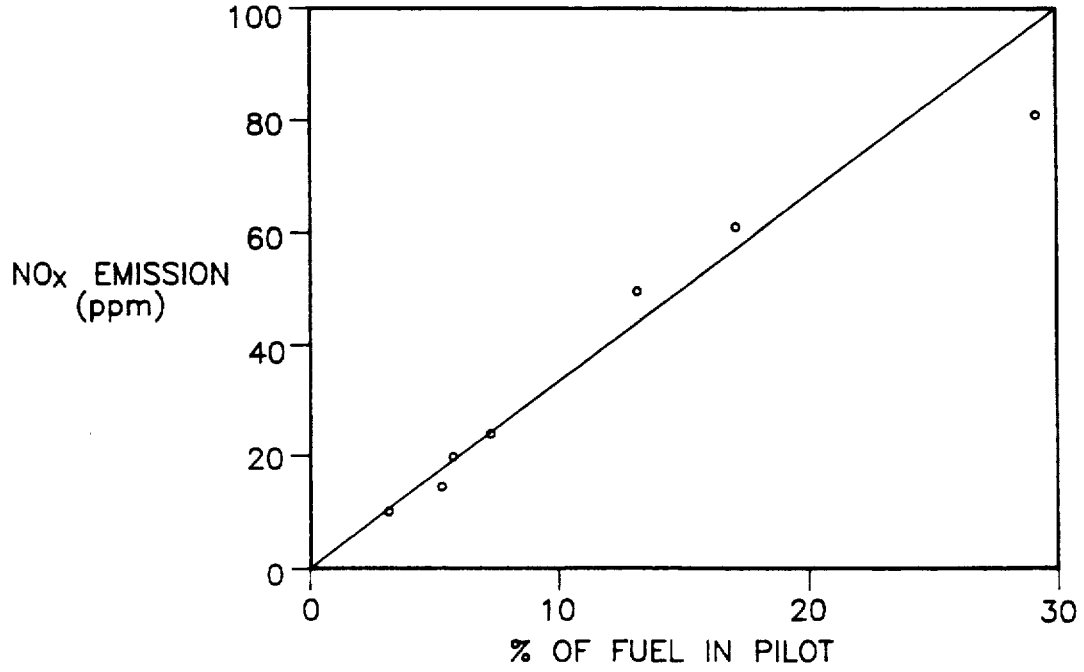
FIG. 1 is a graph of experimental data that shows the relationship between $NO_x$ emissions from a piloted, fuel-lean burner and the amount of fuel in the pilot.

The present invention recognizes that the pilot can be the main source of $NO_x$ emissions from modern, piloted, fuel-lean burners. FIG. 1, based on recent studies on a Siemens V84.2 burner (Siemens AG, Munich, Germany), shows that the relationship between the fraction of fuel burned in the pilot and $NO_x$ emissions from the burner is nearly linear. Therefore, to further reduce $NO_x$ emissions one must focus on improving the pilot. Because the amount of fuel burned in the pilot is a function of burner design and the fuel/air ratio in the main burner, however, it is difficult to reduce the amount of fuel in the pilot. The present invention addresses this limitation by changing the composition of the pilot fuel, rather than by changing the amount of fuel burned in the pilot.

The pilot fuel used in the present invention may be any fuel that has a heating value less than that of the primary fuel in the main flame. Burning a low heating value fuel rather than a high heating value fuel in the pilot reduces the pilot's flame temperature and, therefore, the formation of thermal $NO_x$ in the pilot. Preferably, the pilot fuel also will be low in $CH_i$ to reduce the formation of prompt $NO_x$. The invention is most effective when the pilot fuel has a heating value less than about 800 BTU per standard cubic foot (BTU/scf) (29,810 kJ/m$^3$). Fuels with heating values less than about 800 BTU/scf will be called low heating value fuels. Fuels with heating values greater than 800 BTU/scf will be called high heating value fuels. Low heating value fuels useful with the present invention can inherently have heating values less than about 800

BTU/scf, can be high heating value fuels that are diluted to make them low heating value fuels, or can be made by partially oxidizing high heating value fuels. In this application, partial oxidation refers to a fuel-rich oxidation of a high heating value fuel. The oxidation can be either catalytic or noncatalytic. If the oxidation is noncatalytic, it can be a surface supported combustion, such as combustion in ceramic tubes. The partial oxidation can occur with or without heat removal. If heat is removed, heat removal can occur simultaneous with the partial oxidation or after the partial oxidation is completed. Heat removal in conjunction with partial oxidation is also described in commonly assigned U.S. application Ser. No. 07/701,426, filed on May 15, 1991, the disclosure of which is herein incorporated by reference.

Low heating value fuels that inherently have heating values less than about 800 BTU/scf include methanol, other oxygenated hydrocarbons, producer gas, synthesis gases from coal and oil processes, CO, $H_2$, and mixtures thereof. Fuels such as producer gas, CO, $H_2$, and mixtures thereof are preferred because they contain no $CH_i$ that can cause prompt $NO_x$ to form. High heating value fuels that can be diluted to make low heating value fuels include natural gas, methane, ethane, propane, butane, and liquid fuels such as home heating oils, diesel fuels, and kerosine. Suitable diluents for the high heating value fuels include air, nitrogen, nitrogen-enriched air, carbon dioxide, water, steam, and other inert compounds.

Partial oxidation of high heating value fuels is a preferred method of making low heating value fuels. This method permits the use of a single fuel in the combustion system and is compatible with liquid fuels. Therefore, it is suitable as a retrofit system for existing combustors. Partial oxidation can be better understood by referring to FIG. 2, a schematic of a lean premixed combustion system that incorporates the present invention.

Figure 2:
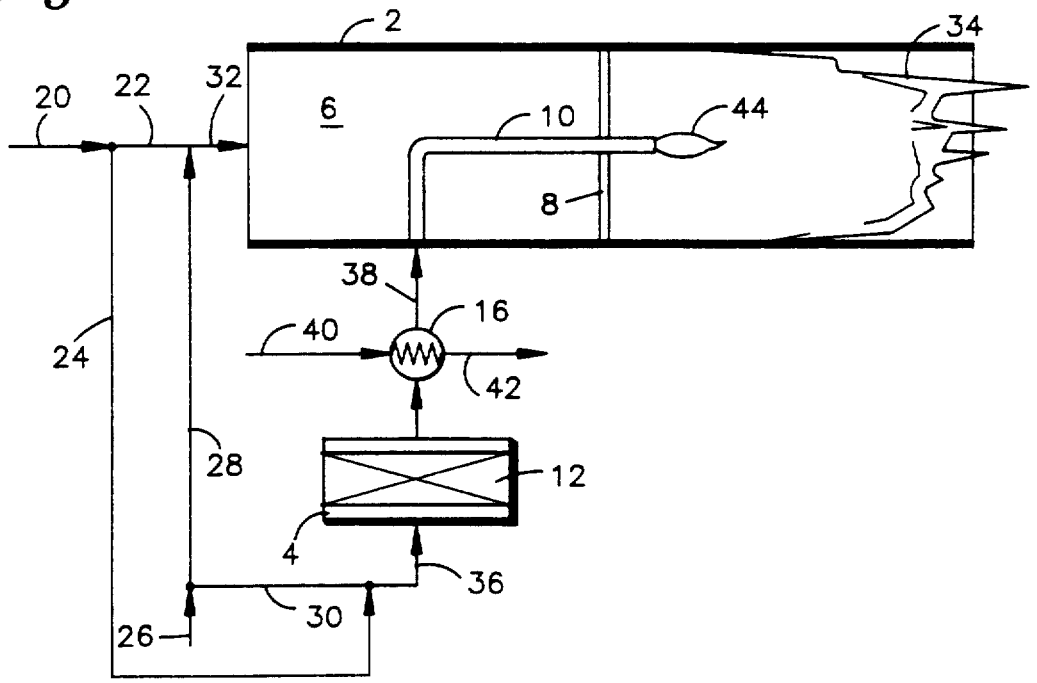
FIG. 2 is a schematic of a combustion system of the present invention that incorporates a partial oxidation stage to generate a pilot fuel with a low heating value.

The combustion system has a burner 2 and a partial oxidation stage 4. The burner 2 may be any piloted, fuel-lean burner, including a conventional or advanced burner with one or more combustion zones. For example, the burner may be a Siemens V84.2 burner. Preferably, the burner will be a lean premixed burner as shown in FIG. 2. The burner 2 includes a mixing chamber 6, in which a fuel and air mix before burning, a flame holder 8 that stabilizes a main flame, and a pilot 10, which also stabilizes the main flame. The partial oxidation stage 4 includes an oxidation catalyst 12. The oxidation catalyst 12 may be any catalyst capable of converting a high heating value fuel to a low heating value fuel with a partial oxidation reaction. Partial oxidation in this context includes a flameless, rapid oxidation or oxidative pyrolysis reaction carried out at a temperature below that normally required to support thermal combustion, that is, conventional combustion with a flame, and below which thermal $NO_x$ forms in appreciable amounts. The term partial oxidation refers to the fact that insufficient oxygen is available to convert the high heating value fuel completely to $CO_2$ and $H_2O$ and to liberate all the chemical energy stored in the fuel. Suitable catalysts include platinum family metals, such as platinum, rhodium, iridium, ruthenium, palladium, and mixtures thereof, chromium oxides, cobalt oxides, alumina, and zeolites. The catalyst may be supported on alumina or a similar substrate and may be in any conventional form, including granules, extrudates, or a coating on a metal heat exchanger surface, metal foil, metal honeycomb, or ceramic honeycomb. The preferred catalysts include platinum family metals, especially platinum-rhodium deposited on an alumina support. If desired, more than one catalyst can be incorporated into a graded catalyst bed. The partial oxidation stage 4 may be designed according to conventional catalytic reactor design techniques.

When the combustion system is operated, a main air stream 20 is split into a first air stream 22 and a second air stream 24. The main air stream 20 may be any oxygen containing stream. Similarly, a main fuel stream 26 is split into a first fuel stream 28 and a second fuel stream 30. Both the main air stream 20 and main fuel stream 26 may be at any suitable temperature and pressure. The main fuel stream 26 may comprise $C_1$ to $C_{20}$ hydrocarbons, $C_1$ to $C_{20}$ hydrocarbon oxygenates, and blends thereof. Suitable gaseous fuels include natural gas, methane, and propane. Suitable liquid fuels include kerosine, No. 1 heating oil, No. 2 heating oil, and conventional aviation turbine fuels such as Jet A, Jet B, JP-4, JP-5, JP-7, and JP-8. A liquid fuel should be vaporized or atomized before mixing with air or while being mixed with air. Any conventional means known in the art may be used to vaporize or atomize the fuel.

The first air stream 22 mixes with the first fuel stream 28 to form a first fuel/air mixture 32 that has an equivalence ratio less than 1. The equivalence ratio is the ratio of the actual fuel/air ratio to the stoichiometric fuel/air ratio. An equivalence ratio greater than 1 indicates fuel-rich conditions, while a ratio less than 1 indicates fuel-lean conditions. The first fuel/air mixture 32 enters the mixing chamber 6 where the fuel and air thoroughly mix before burning in a main flame 34.

The second air stream 24 mixes with the second fuel stream 30 to form a second fuel/air mixture 36 that has an equivalence ratio greater than 1. The second fuel/air mixture 36 may have an equivalence ratio greater than about 2 and, preferably, an equivalence ratio between about 2.5 and about 8. Most preferably, the equivalence ratio will be about 3 to about 5. The second fuel/air mixture 36 flows into the partial oxidation stage 4 where it contacts the oxidation catalyst 12 and partially oxidizes in an exothermic reaction to generate a partial oxidation product stream 38. The product stream 38 comprises $H_2$, CO, $CO_2$, $H_2O$, $N_2$, a small amount of unreacted fuel, and possibly, some other hydrocarbon species. Partially oxidizing the fuel reduces the amount of hydrocarbon fuel available to form $CH_i$ fragments in a downstream pilot flame and therefore, reduces the amount of prompt $NO_x$ formed in the pilot 10. The amount of $H_2$, CO, and unreacted hydrocarbon fuel actually formed depends on the temperature in the partial oxidation stage 4, which may range from about 150° C. (300° F.) to about 980° C. (1800° F.). At higher temperatures, more fuel is converted to $H_2$ and CO than at lower temperatures due to changes in the equilibrium product composition. When the combustion system is started, there may be insufficient heat available in the system to start the partial oxidation reaction. In such cases, the catalyst 12 can be preheated with resistive heating, a secondary working fluid, or by temporarily igniting a flame upstream of the catalyst 12. Alternately, the main flame 34 can be ignited and run under stable conditions without a pilot or with a pilot that burns the high heating value fuel while the catalyst is heated with compressor air, burner exhaust gases, or another thermal source.

Figure 3:
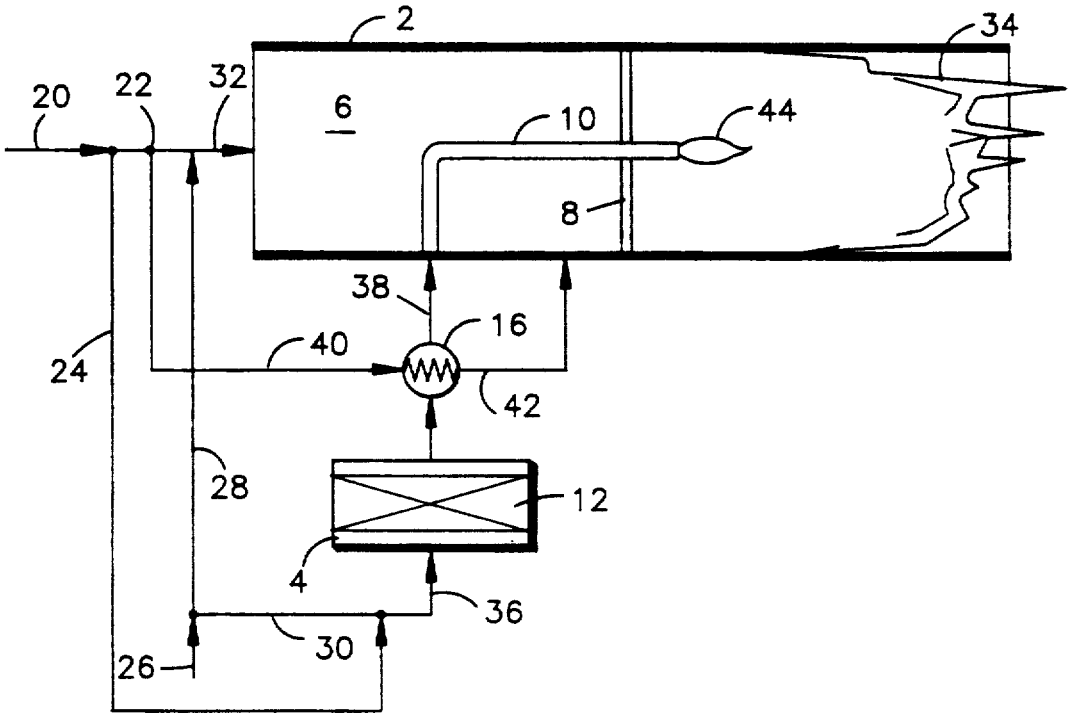
FIGS. 3 and 4 are schematics of the system from FIG. 2 in which heat extracted from the low heating value fuel is recycled to the combustion system.
Figure 4:
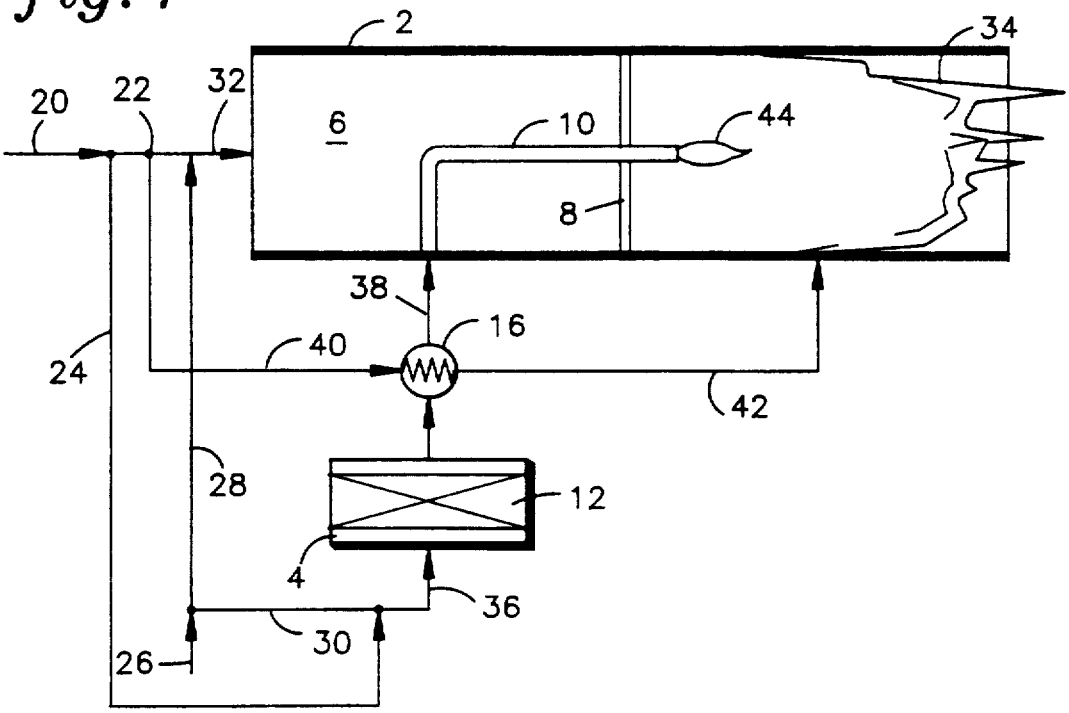

Because the partial oxidation is exothermic, it produces heat that may be removed from the product stream 38. Cooling the product stream 38 lowers the pilot flame temperature and decreases the formation of thermal $NO_x$ in the pilot. The product stream 38 may be cooled downstream of the partial oxidation stage 4 or by cooling the partial oxidation stage 4 itself. Preferably, heat will be removed from the product stream 38 downstream of the partial oxidation stage 4 to permit the partial oxidation stage 4 to operate at a higher temperature. Operating the partial oxidation stage 4 at a higher temperature shifts the reaction equilibrium to favor the production of $H_2$ and CO, rather than unreacted fuel, $CO_2$, and $H_2O$. Larger amounts of $H_2$ and CO decrease the amount of $CH_i$ available to create prompt $NO_x$ in the pilot. The product stream 38 can be cooled with the heat transfer stream 40 in a heat transfer means 16, which may be any conventional heat transfer device. The heat transfer stream 40 may be any stream, such as water, air, or a process stream, that is at a temperature suitable to cool the product stream 38. Heat removed from the product stream 38 may transferred to the surrounding air, a cooling water system, or recycled to the combustion system to improve the system's thermal efficiency. For example, as shown in FIG. 3, the heat transfer stream 40 may be an air stream that is heated in the heat transfer means 16 to produce a heated stream 42. The heated stream 42 can be added to the mixing chamber 6 to serve as part of or all of the primary air. Alternately, the heated stream 42 can be added to the burner 2 downstream of the pilot 10 to serve as secondary air, as shown in FIG. 4.

After leaving the partial oxidation stage 4 and after any cooling, the partial oxidation product stream 38 enters the pilot burner 10, where it produces a pilot flame 44 that stabilizes the main flame 34. Preferably, the pilot flame temperature will be less than about 1540° C. (2800° F.) to minimize the formation of thermal $NO_x$.

Although the invention has been described in the context of partial oxidation using a catalyst, the method and system of the present invention can be adapted for use with noncatalytic partial oxidation. For example, the partial oxidation stage 4 that contains the catalyst 12 could be replaced with a noncatalytic, surface supported combustion device, such as a porous ceramic burner or a bank of ceramic tubes.

The present invention can be used with a variety of piloted, fuel-lean, continuous combustion systems, including home furnaces, industrial boilers and furnaces, and gas turbine combustors to provide several advantages over the prior art. For example, burning a low heating value fuel in the pilot permits $NO_x$ emissions from combustion systems that are already low $NO_x$ emitters to be further reduced. This advantage can be obtained in systems that require a pilot for all operating conditions and those that require a pilot only during turndown operations. In addition, the use of a partial oxidation stage to produce the low heating value pilot fuel provides the combustion system of the present invention with a single fuel capability. As a result, the present invention is an ideal retrofit for existing combustion systems that need to reduce $NO_x$ emissions.

The invention is not limited to the particular embodiments shown and described herein. Various changes and modifications may be made without departing from the spirit or scope of the claimed invention.

We claim:

1. A method of burning a hydrocarbon fuel in a combustion system including burning the fuel in a main burner under fuel-lean conditions to produce a main flame and burning a pilot fuel in a pilot burner to stabilize the main flame, wherein the improvement comprises:

(a) diluting a high heating value fuel to produce a low heating value fuel that has a heating value less than about 800 BTU/scf; and (b) burning the low heating value fuel in the pilot burner to limit the amount of $NO_x$ produced in the pilot burner.

2. The method of claim 1, wherein the high heating value fuel is diluted with a diluent selected from the group consisting of nitrogen, nitrogen-enriched air, carbon dioxide, water, and steam.

3. A method of burning a hydrocarbon fuel in a combustion system including burning the fuel in a main burner under fuel-lean conditions to produce a main flame and burning a pilot fuel in a pilot burner to stabilize the main flame, wherein the improvement comprises:

(a) producing a low heating value fuel by partial oxidation of a high heating value fuel selected from the group consisting of $C_1$ to $C_{20}$ hydrocarbons, $C_1$ to $C_{20}$ hydrocarbon oxygenates, and blends thereof, wherein the low heating value fuel has a heating value less than about 800 BTU/scf;

(b) cooling the low heating value fuel; and (c) burning the low heating value fuel in the pilot burner to limit the amount of $NO_x$ produced in the pilot burner.

4. The method of claim 3, wherein heat extracted from the low heating value fuel by cooling it is recycled to the combustion system to improve the thermal efficiency of the combustion system.

5. The method of claim 3, wherein the high heating value fuel is partially oxidized by contacting it with a catalyst selected from the group consisting of platinum, rhodium, iridium, ruthenium, palladium, and mixtures thereof, chromium oxides, cobalt oxides, alumina, and zeolites.

6. A combustion system for burning a hydrocarbon fuel with limited $NO_x$ emissions that includes a main burner and a pilot burner, wherein the improvement comprises:

(a) a partial oxidation stage capable of converting a high heating value fuel to a low heating value fuel in a partial oxidation reaction, wherein the low heating value fuel has a heating value less than about 800 BTU/scf;

(b) heat transfer means capable of removing heat from the low heating value fuel to cool it before it is burned in the pilot burner; and (c) means for burning the low heating value fuel in the pilot burner.

7. The system of claim 6, further comprising means for recycling the heat removed from the low heating value fuel to the combustion system to improve the thermal efficiency of the combustion system.

8. The system of claim 6, wherein the partial oxidation stage includes a catalyst selected from the group consisting of platinum, rhodium, iridium, ruthenium, palladium, and mixtures thereof, chromium oxides, cobalt oxides, alumina, and zeolites.

* * * * *